US008165490B2

(12) United States Patent
Yamazoe

(10) Patent No.: US 8,165,490 B2
(45) Date of Patent: Apr. 24, 2012

(54) IMAGE FORMING APPARATUS INCLUDING A COLLECTING PORTION INSIDE GUIDE MEMBERS TO COLLECT AND STORE LIQUID DROPLETS

(75) Inventor: Yoshikazu Yamazoe, Toyonaka (JP)

(73) Assignee: Ricoh Company, Limited, Tokyo (JP)

( * ) Notice: Subject to any disclaimer, the term of this patent is extended or adjusted under 35 U.S.C. 154(b) by 335 days.

(21) Appl. No.: 12/458,176

(22) Filed: Jul. 2, 2009

(65) Prior Publication Data

US 2010/0003048 A1 Jan. 7, 2010

(30) Foreign Application Priority Data

Jul. 2, 2008 (JP) ..... 2008-173431

(51) Int. Cl.
*G03G 21/20* (2006.01)
*G03G 15/00* (2006.01)

(52) U.S. Cl. ..... 399/92; 399/97; 399/401; 399/405

(58) Field of Classification Search ..... 399/92, 399/97, 401, 405
See application file for complete search history.

(56) References Cited

U.S. PATENT DOCUMENTS

| | | | | |
|---|---|---|---|---|
| 7,359,655 | B2 * | 4/2008 | Ito | 399/92 |
| 2007/0019981 | A1 * | 1/2007 | Kawamata | 399/92 |
| 2008/0193162 | A1 | 8/2008 | Yamazoe et al. | |
| 2009/0060572 | A1 | 3/2009 | Naitoh et al. | |
| 2009/0074440 | A1 | 3/2009 | Nanno et al. | |

FOREIGN PATENT DOCUMENTS

| | | |
|---|---|---|
| CN | 101004568 | 7/2007 |
| JP | 06-118827 | 4/1994 |
| JP | 07-261585 | 10/1995 |
| JP | 2664313 | 6/1997 |
| JP | 3121133 | 10/2000 |
| JP | 2001-228735 | 8/2001 |
| JP | 2003-146514 | 5/2003 |
| JP | 2005-257853 | 9/2005 |
| JP | 2006-276215 | 10/2006 |
| JP | 2006-322994 | 11/2006 |
| JP | 2007-240966 | 9/2007 |

OTHER PUBLICATIONS

Office Action dated Feb. 28, 2011 issued in corresponding Chinese Application No. 200910139698.4.

* cited by examiner

*Primary Examiner* — David Gray
*Assistant Examiner* — Joseph S Wong
(74) *Attorney, Agent, or Firm* — Harness, Dickey & Pierce, P.L.C.

(57) ABSTRACT

An image forming apparatus includes a transfer unit, a fixing unit, a discharging unit, and multiple guide members. The transfer unit transfers an image onto a transfer sheet. The fixing unit fixes the image to the transfer sheet by application of heat and conveys the fixed transfer sheet to a further downstream portion of the image forming apparatus. The discharging unit discharges the transfer sheet to an external portion of the image forming apparatus. The multiple guide members form a sheet conveyance path that has first and second paths including a hollow portion defined by the multiple guide members to enable an air current generated during image forming to pass therethrough.

19 Claims, 11 Drawing Sheets

IMAGE FORMING APPARATUS INCLUDING A COLLECTING PORTION INSIDE GUIDE MEMBERS TO COLLECT AND STORE LIQUID DROPLETS

CROSS-REFERENCE TO RELATED APPLICATIONS

The present invention claims priority pursuant to 35 U.S.C. §119 from Japanese Patent Application No. 2008-173431, filed on Jul. 2, 2008 in the Japan Patent Office, the contents and disclosure of which are hereby incorporated by reference herein in their entirety.

BACKGROUND OF THE INVENTION

1. Field of the Invention

Example embodiments of the present patent application relate to an image forming apparatus such as a copier, facsimile machine, printer, plotter, and multiple function machine including two or more functions of these apparatuses and devices that form images on both sides of a recording medium.

2. Discussion of the Related Art

Electrophotographic image forming apparatuses generally include a fixing unit that employs a heat fixing system for fixing a toner image formed on a recording medium to the recording medium by application of heat and pressure. During a fixing process performed by the heat fixing system, moisture contained in the recording medium evaporates therefrom, which builds up condensation in the electrophotographic image forming apparatus.

Several techniques have been proposed to reduce or eliminate the accumulation of condensation in the image forming apparatus.

For example, in some related-art image forming apparatuses, if a fixing unit, which fixes an image to a transfer sheet serving as a recording medium by application of heat and pressure, starts to fix the image when the temperature in the related-art image forming apparatus is relatively low, moisture in the transfer sheet evaporates and builds up as condensation on transfer sheet guide plates that form sheet conveyance paths of the image forming apparatus.

Such a sheet conveyance path is generally provided to an image forming apparatus for a transfer sheet to pass therethrough when printing an image on a single side or both sides of the transfer sheet. The sheet conveyance path has a relatively small amount of water because the transfer sheet is heated in the fixing unit and therefore a temperature of the transfer sheet guide plate is increased, and the transfer sheet passing through the sheet transfer conveyance path draws moisture from the image forming apparatus.

Further, some related-art image forming apparatuses include an outer cover that has a guide member for forming the fixing unit and a transfer sheet reverse path, and a hollow portion that is formed between the guide member and the outer cover in order to further reduce the creation of water droplets and prevent condensation in the image forming apparatus.

However, these approaches require additional components and add to the overall size of the apparatus, which is undesirable in the face of continued market demand for compact and inexpensive configurations.

Further, as the number of operations for allowing passage of transfer sheets such as single-side printing is increased, the transfer sheet reverse path formed of guide members can receive more water droplets adhered thereto. When printing both sides of a transfer sheet after completion of a large amount of single-side printing, water droplets accumulated on the transfer sheet reverse path can adhere to the transfer sheet. This action can cause transfer failure at a transfer part such as a secondary transfer roller while forming an image, and produce defective images as a result.

Specifically, a compact image forming apparatus having a sheet conveyance path extending in a vertical direction generally includes a transfer sheet reverse path with a branched section for printing both sides of a transfer sheet after fixing the first side thereof. This configuration can build up condensation more easily.

Condensation is most likely to accumulate immediately after fixing. To eliminate water droplets or liquid droplets, holes or slots are formed on a transfer surface of each guide to reduce an area to which water droplets adhere. However, water droplets can still adhere to the transfer sheet guide plates of the sheet reverse path while printing the first side of a transfer sheet. Similarly, a duct member or other element or component to reduce or eliminate water droplets or condensation cannot be provided to prevent adhesion of water droplets to the transfer sheet guide plates because space for such an additional component is limited and cost can increase due to an increasing number of mechanical parts.

In other related-art image forming apparatuses having a hollow portion provided for eliminating condensation, the configuration can be simple and low-cost because no additional unit or device to avoid water droplets is provided thereto. However, when a hollow portion is located above the transfer sheet reverse path, water vapor produced in the fixing unit can travel via the transfer sheet reverse path to the hollow portion, and therefore water vapor can build up and condense on the transfer sheet guide plates that form the transfer sheet reverse path before it reaches the hollow portion to accumulate as water droplets for condensation. The accumulated water droplets can adhere to the transfer sheet to cause transfer failure at the transfer section when printing both sides of a next transfer sheet, which can produce defective images.

SUMMARY OF THE INVENTION

Example aspects of the present patent application have been made in view of the above-described circumstances.

Example aspects of the present patent application provide an image forming apparatus that has a compact body and a less expensive configuration and can eliminate water droplets without providing any additional unit and prevent a production of defective images due to water droplets from condensation of vapor even immediately after printing a large amount of single-side copies.

In one exemplary embodiment, an image forming apparatus includes a transfer unit, a fixing unit, a discharging unit, and multiple guide members. The transfer unit transfers an image onto a transfer sheet. The fixing unit is disposed downstream from the transfer unit in a direction of conveyance of the transfer sheet. The fixing unit fixes the image to the transfer sheet by application of heat and conveys the fixed transfer sheet to a further downstream portion of the image forming apparatus. The discharging unit is disposed downstream from the fixing unit in the direction of conveyance of the transfer sheet. The discharging unit discharges the transfer sheet to an external portion of the image forming apparatus. The multiple guide members are disposed above the fixing unit to form a sheet conveyance path. The sheet conveyance path includes a first path through which the transfer sheet is conveyed toward the discharging unit and a second path through which the transfer sheet from the first path is conveyed to receive another image on the other side thereof. Both the first path and the second path of the sheet conveyance path include a hollow portion defined by the multiple guide members to enable an air current generated during image forming to pass therethrough.

The air current may include vapor generated in a heated area of the fixing unit.

The hollow portion may extend to enable the air current to flow therein in a direction substantially perpendicular to the direction of conveyance of the transfer sheet.

The above-described image forming apparatus may further include a side cover having electrical components mounted thereon. The air current that includes the vapor may flow in a direction opposite the side cover having the electrical components mounted thereon.

The above-described image forming apparatus may further include side covers disposed extending in a direction intersecting a longitudinal axis of the fixing unit at both ends of the fixing unit. Each of the side covers may have multiple openings therein. The air current may be generated by passing through the multiple openings of the side covers.

The above-described image forming apparatus may further includes side covers disposed extending in a direction intersecting a longitudinal axis of the fixing unit at both ends of the fixing unit. Each of the side covers may have multiple openings therein. The air current may be generated by a forcedly generated flow of air substantially parallel to the longitudinal axis of the fixing unit.

At least one of the multiple guide members may include a moisture absorbing material to absorb and store liquid droplets from condensation of vapor generated in the fixing unit within the hollow portion.

One of the multiple guide members facing the hollow portion may include a collecting portion to collect and store liquid droplets from condensation of vapor generated in the fixing unit and another one of the multiple guide members facing the hollow portion may include a liquid guide member to guide the liquid droplets to the collecting portion.

The collecting portion of the liquid droplets may be included in the fixing unit.

The multiple guide members may form a wind tunnel to allow the air current to pass through the hollow portion in the fixing unit.

The air current may cool down the hollow portion surrounded by the multiple guide members.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
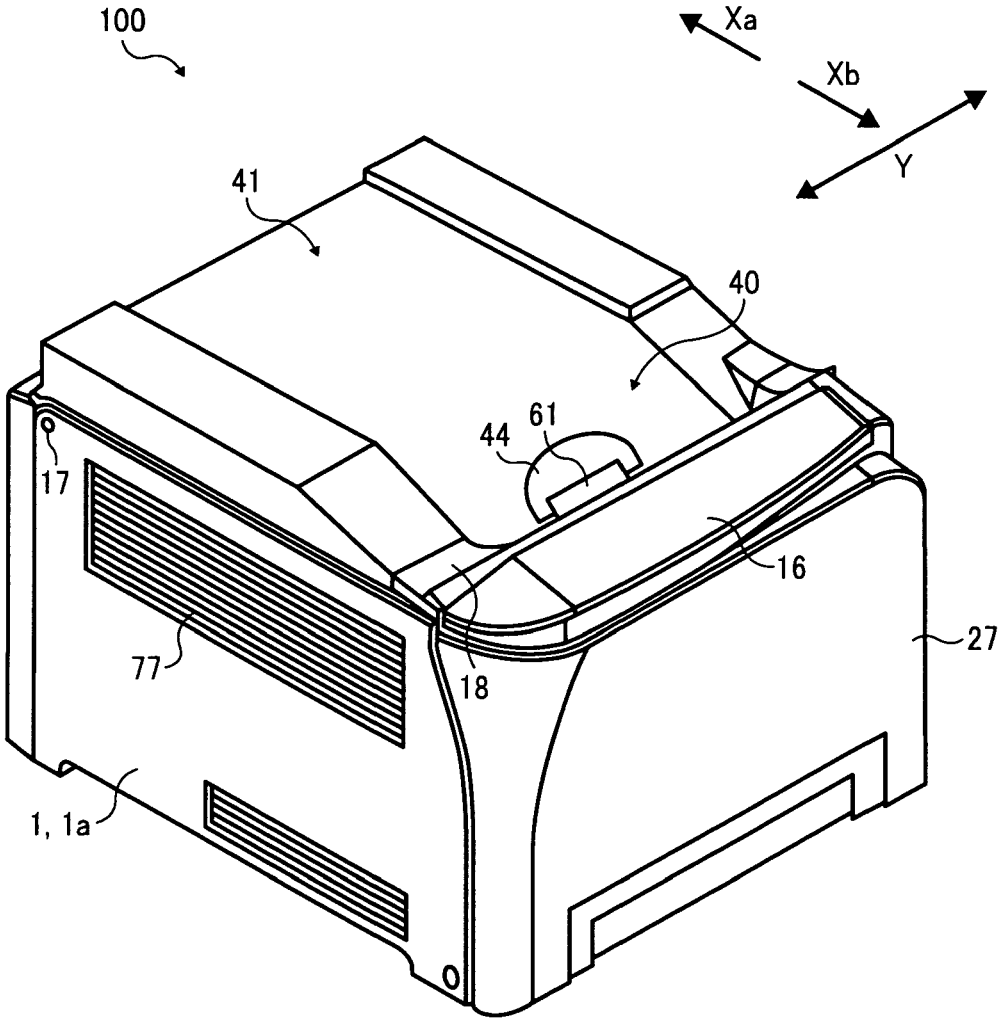
FIG. 1 is a perspective view of an image forming apparatus according to example embodiments of the present patent application.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present patent application. As used herein, the singular forms "a", "an" and "the" are intended to include the plural forms as well, unless the context clearly indicates otherwise. It will be further understood that the terms "includes" and/or "including", when used in this specification, specify the presence of started features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this patent application is not intended to be limited to the specific terminology so selected and it is to be understood that each specific element includes all technical equivalents that operate in a similar manner.

Referring now to the drawings, wherein like reference numerals designate identical or corresponding parts throughout the several views, example embodiments of the present patent application are described.

Now, example embodiments of the present patent application are described in detail below with reference to the accompanying drawings.

Descriptions are given, with reference to the accompanying drawings, of examples, example embodiments, modification of example embodiments, etc., of an image forming apparatus according to the present patent application. Elements having the same functions and shapes are denoted by the same reference numerals throughout the specification and redundant descriptions are omitted. Elements that do not require descriptions may be omitted from the drawings as a matter of convenience. Reference numerals of elements extracted from the patent publications are in parentheses so as to be distinguished from those of example embodiments of the present patent application.

The present patent application includes a technique applicable to any image forming apparatus. For example, the technique of the present patent application is implemented in the most effective manner in an electrophotographic image forming apparatus.

Exemplary Embodiment 1

Figure 2:
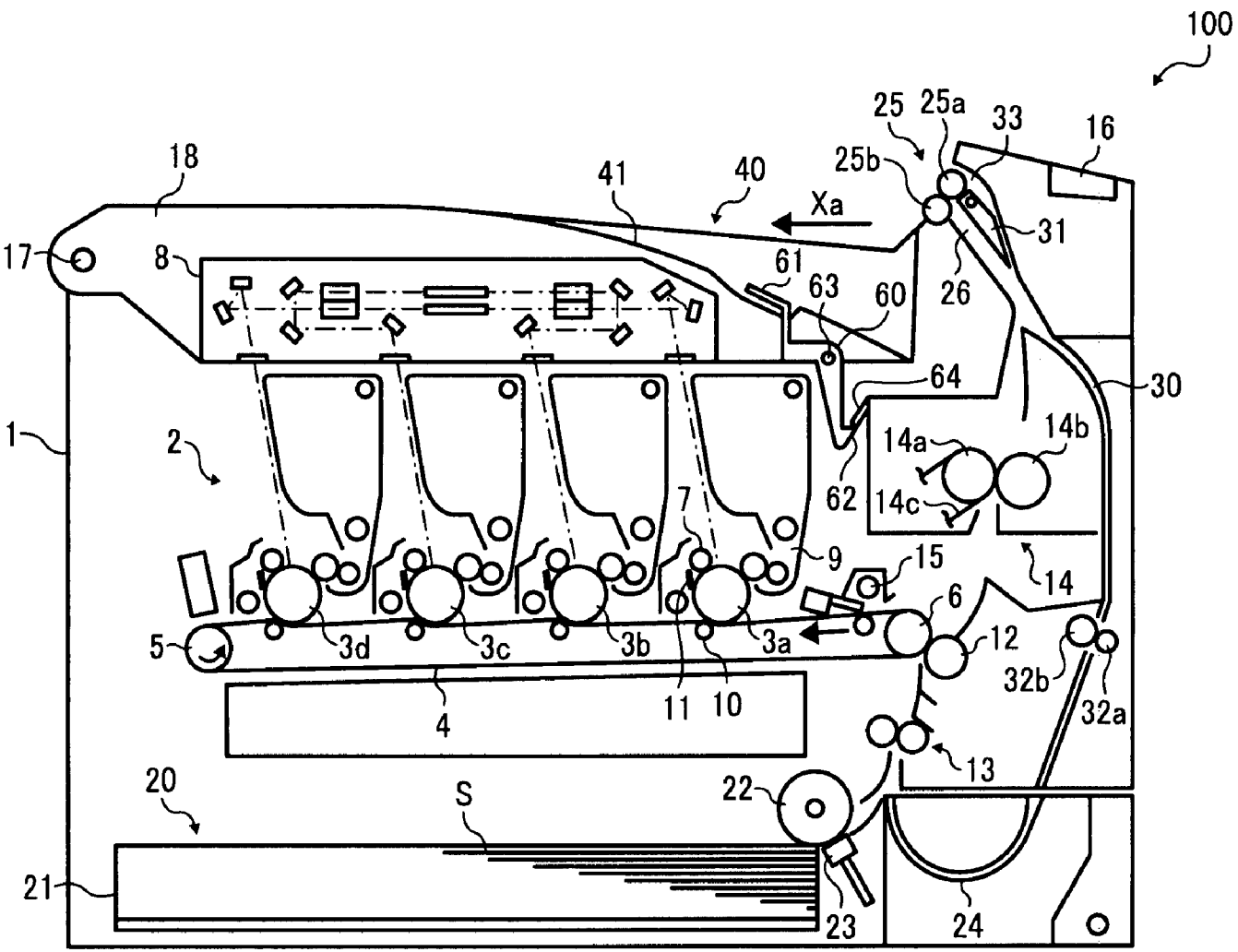
FIG. 2 is a longitudinal sectional view illustrating a schematic configuration of the image forming apparatus of FIG. 1.
Figure 3:
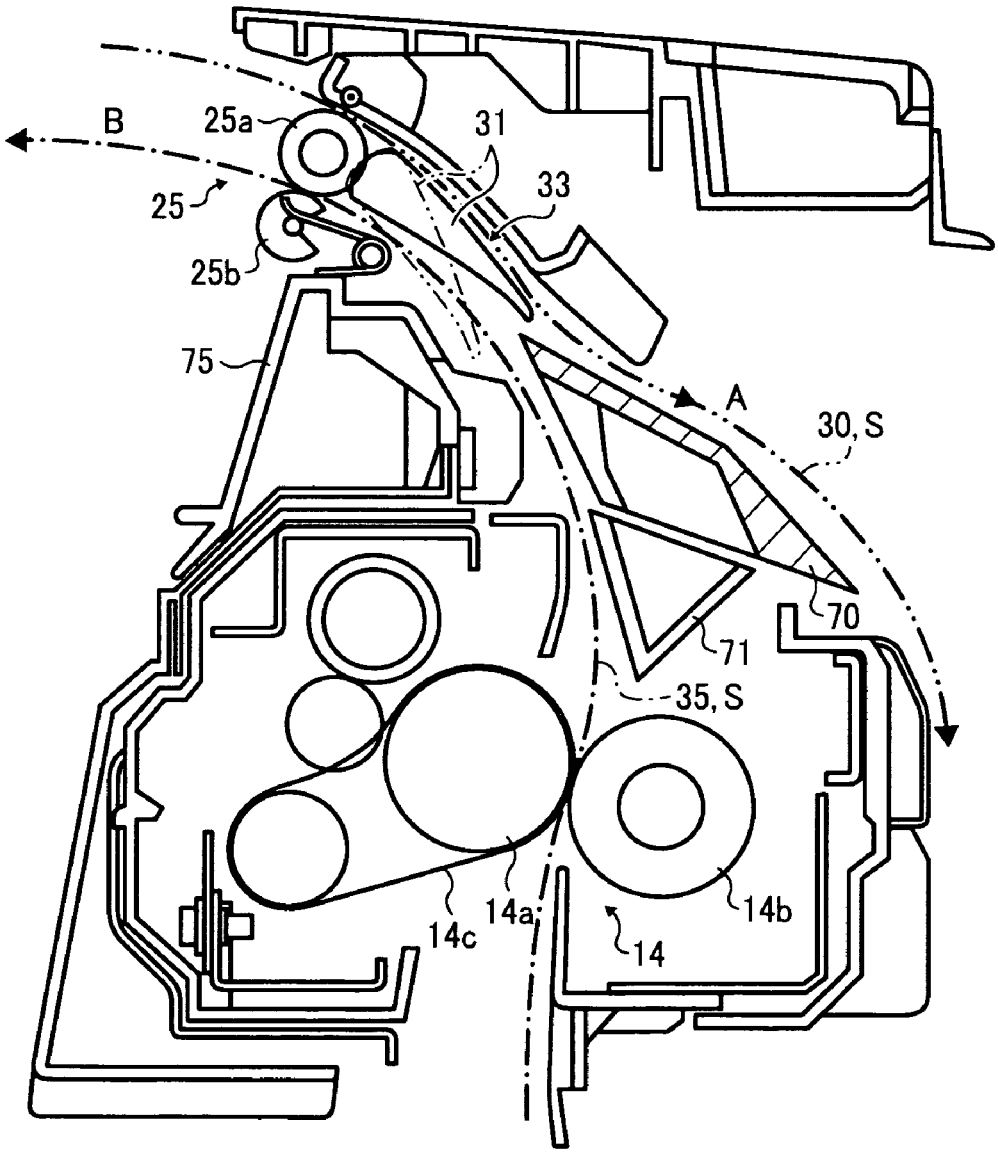
FIG. 3 is a cross-sectional view of the image forming apparatus of FIG. 1, partially around the fixing unit and sheet conveyance paths.

Referring to FIGS. 1 through 3, descriptions are given of a schematic configuration and operations of an image forming apparatus 100 according to Example Embodiment 1 of the present patent application.

FIG. 1 illustrates a perspective view of the image forming apparatus 100, and FIG. 2 illustrates a vertical cross-section of an interior of the image forming apparatus 100 of FIG. 1.

The image forming apparatus 100 can be any of a copier, a printer, a facsimile machine, a plotter, and a multifunction printer including at least one of copying, printing, scanning, plotter, and facsimile functions. In this non-limiting exemplary embodiment, the image forming apparatus 100 functions as a full-color printing machine for electrophotographically forming a toner image based on image data on a recording medium (e.g., a transfer sheet).

The toner image is formed with four single toner colors, which are yellow, cyan, magenta, and black. Reference symbols "Y", "C", "M", and "K" represent yellow color, cyan color, magenta color, and black color, respectively.

The image forming apparatus 100 shown in FIGS. 1 and 2 includes a main body 1, an image forming part 2, a sheet feeding part 20, a sheet discharging part 25, a sheet stacking part 40.

The image forming part 2 is located at a substantially center part of the main body 1 of the image forming apparatus 100 to form one or more images on a transfer sheet.

The sheet feeding part 20 is disposed below the image forming part 2 to feed and convey a recording medium such as a transfer sheet S or other sheet-like recording medium.

After image forming part 2 form the image on the transfer sheet, the sheet discharging part 25 discharges the transfer sheet S in a direction from the near side or front side of the main body 1 of the image forming apparatus 100, which is the right-hand side on FIG. 2, to the far side or rear side of the main body 1 of the image forming apparatus 100, which is the left-hand side on FIG. 2.

The sheet stacking part 40 is disposed above the image forming part 2 to stack the transfer sheets that are discharged from the sheet discharging part 25 in a direction (Xa) of discharging a transfer sheet S, which is described below.

The transfer sheet that serves as a recording medium includes a sheet-like recording medium (e.g., thick paper, postcard, envelope, regular paper, and thin paper), a coated paper (e.g., art paper), OHP sheet or OHP film, and a tracing paper, and indicates a transferable image forming material.

The image forming apparatus 100 shown in FIGS. 1 and 2 corresponds to a tandem-type color image forming apparatus. In FIG. 1, "Xa" represents a direction of discharging a transfer sheet, "Xb" represents a direction opposite the direction Xa, and "Y" represents a sheet widthwise direction perpendicular to the sheet discharge direction Xa.

The image forming part 2 is also referred to as an "image recording part 2" that forms an image as a record on the transfer sheet S.

The sheet stacking part 40 is also referred to as a sheet accumulation part 40 to accommodate the output sheet therein.

As shown in FIG. 2, the image forming part 2 includes drum-shaped photoconductors 3*a*, 3*b*, 3*c*, and 3*d*, each of which serves as an image carrier. The photoconductors 3*a*, 3*b*, 3*c*, and 3*d* form respective toner images with corresponding toners of different colors. Specifically, the photoconductors 3*a*, 3*b*, 3*c*, and 3*d* shown in FIG. 2 form a yellow toner image, a cyan toner image, a magenta toner image, and a black toner image, respectively, on each surface thereof. The photoconductors 3*a*, 3*b*, 3*c*, and 3*d* are disposed at given intervals and substantially parallel to each other.

The intermediate transfer belt 4 that serves as a transfer unit is disposed below and facing the photoconductors 3*a*, 3*b*, 3*c*, and 3*d*. The intermediate transfer belt 4 shown in FIG. 2 is spanned around and extended by multiple support rollers 5 and 6 and rotates in a direction indicated by arrow in FIG. 2 or in a counterclockwise direction in FIG. 2.

Although the intermediate transfer member illustrated herein is a belt-shaped member, example embodiments of the present patent application are not intended to be limited to this configuration. For example, the intermediate transfer member of the present patent application may be a drum-shaped member.

Since units and components around each of the photoconductors 3*a*, 3*b*, 3*c*, and 3*d* have similar structures and functions, except that respective toners are of different colors, which are yellow, cyan, magenta, and black toners, the descriptions below will be applied to any of the photoconductors 3*a*, 3*b*, 3*c*, and 3*d* when the units and components are described without suffixes. Further, the discussion below occasionally uses reference numerals without suffixes "a", "b", "c", and "d" for specifying components of the image forming apparatus 100.

The photoconductor 3*a* is surrounded by image forming units and components, specifically a charging unit 7, a light scanning unit or LSU 8, a developing unit 9, a primary transfer member 10, and a cleaning unit 11.

The charging unit 7 uniformly charges the surface of the photoconductor 3*a*.

The LSU 8 serves as an optical writing unit to emit a laser light beam to expose or irradiate the surface of the photoconductor 3 according to image data so that an electrostatic latent image is formed on the surface of the photoconductor 3.

The developing unit 9 develops the electrostatic latent image formed on the surface of the photoconductor 3 into a visible toner image.

The primary transfer member 10 is disposed facing the photoconductor 3 via the intermediate transfer belt 4.

The cleaning unit 11 cleans the photoconductor 3 by removing residual toner remaining on the surface of the photoconductor 3 after the transfer of the image onto the intermediate transfer belt 4.

The charging unit 7, the LSU 8, the developing unit 9, the primary transfer member 10, and the cleaning unit 11 are disposed around the photoconductor 3 in this order.

When the image forming apparatus 100 starts an image forming operation, the photoconductor 3*a* rotates in a clockwise direction of FIG. 2. At this time, the charging unit 7 uniformly charges the surface of the photoconductor 3*a* to a give polarity. The LSU 8 then emits the laser light beam according to the image data to irradiate the surface of the photoconductor 3*a*, thereby forming an electrostatic latent image thereon. The developing unit 9 develops the electrostatic latent image into a yellow toner image. Then, the primary transfer member 10 transfers the yellow toner image onto a surface of the intermediate transfer belt 4.

The same image forming operation is performed with respect to the photoconductors 3*b*, 3*c*, and 3*d*. Accordingly, the yellow toner image, the cyan toner image, the magenta toner image, and the black toner image that are formed on the photoconductors 3*a*, 3*b*, 3*c*, and 3*d*, respectively, are sequentially overlaid on the surface of the intermediate transfer belt 4, thereby forming an overlaid four-color toner image is formed.

The image forming apparatus 100 further includes a secondary transfer roller 12 that is disposed facing the support roller 6 via the intermediate transfer belt 4.

The sheet feeding part 20 is disposed below the image forming part 2 and includes a sheet feed tray 21, a sheet feed roller 22, a friction pad 23, and a sheet reverse path 24.

The sheet feed tray 21 serves as a sheet container to accommodate a transfer sheet S of multiple transfer sheets serving as recording media. The transfer sheet S corresponds to a transfer paper, recording paper, resin film, or the like.

The sheet feed roller 22 feeds the transfer sheet S accommodated in the sheet feed tray 21.

The friction pad 23 serves as a sheet separation unit to separate multi-fed sheets one by one.

The sheet reverse path 24 is formed to convey the transfer sheet S therethrough when performing duplex printing or forming images on both sides of the transfer sheet S.

The transfer sheet S fed from the sheet feeding part 20 is conveyed to a pair of registration rollers 13 until the leading edge thereof contacts against the pair of registration rollers 13. By stopping at the pair of registration rollers 13, skew or misalignment of the leading edge of the transfer sheet S is corrected and adjusted, if any. Then, the pair of registration rollers 13 starts its rotation again to feed the leading edge of the transfer sheet S in synchronization with movement of the intermediate transfer belt 4 so that the four-color toner image formed on the intermediate transfer belt 4 can be timely transferred onto the transfer sheet S at a secondary transfer nip portion formed between the secondary transfer roller 12 and the support roller 6.

After receiving the four-color toner image at the secondary transfer nip portion, the transfer sheet S is conveyed to the fixing unit 14.

The fixing unit 14 includes a fixing roller 14*a*, a pressure roller 14*b*, and a fixing belt 14*c*. The fixing belt 14*c* is spanned around the fixing roller 14*a*, and the pressure roller 14*b* presses against the fixing roller 14*a* via the fixing belt 14*c*. The fixing unit 14 fixes the four-color toner image to the transfer sheet S by application of heat and pressure.

Although the fixing unit 14 illustrated herein generally has the above-described configuration, example embodiments of the present patent application are not intended to be limited to this configuration. For example, the fixing unit of the present patent application may be a roller type including a heater therein, a heating method using an induction heater, etc.

The fixed transfer sheet S is then conveyed by a pair of sheet discharging rollers 25*a* and 25*b* of a sheet discharging part 25 and discharged to the sheet stacking part 40 in a face-down manner. The sheet stacking part 40 is formed on top of the main body 1 of the image forming apparatus 100.

Residual toner or foreign materials remaining on the surface of the intermediate transfer belt 4 after transfer are removed by a belt cleaning unit 15 so as to be ready for subsequent image forming operations.

Referring to FIGS. 2 and 3, descriptions are given of a configuration around a sheet discharging part 25 and a sheet reverse path 30.

FIG. 3 is a cross-sectional view of the image forming apparatus 100, partially around the sheet discharging part 25 and the sheet reverse path 30 of the fixing unit 14.

A separation claw 31 is disposed in the vicinity of the sheet discharging roller 25*a*. The separation claw 31 serving as a switching guide member is rotatable about a shaft thereof to switch a direction of conveyance of the transfer sheet S that has an image formed on one side either to the sheet discharging part 25 or to the sheet reverse path 30. When the separation claw 31 is at a position indicated by a solid line, it guides the fixed transfer sheet S to the sheet discharging part 25 so that the transfer sheet S can be conveyed by the pair of sheet discharging rollers 25*a* and 25*b* to be discharged to a sheet stacking tray 41 of the sheet stacking part 40.

The image forming apparatus 100 shown in FIG. 1 includes various paths and rollers for reversing and re-feeding the transfer sheet S so that images can be formed on the both sides of the transfer sheet S automatically. Specifically, the image forming apparatus 100 further includes a switchback path 33 above the sheet discharging part 25.

The transfer sheet S fed by the sheet feeding part 20 passes through the secondary transfer nip portion of the secondary transfer roller 12 and the fixing unit 14, where an image is formed on the one side of the transfer sheet S. At this time, the separation claw 31 rotates in a clockwise direction in FIG. 1 so that the transfer sheet S with the image on one side thereof is guided over an upper face of the separation claw 31 to an upper portion of the sheet discharging roller 25*a* to change the direction of conveyance of the transfer sheet S to be reversed. As the sheet discharging roller 25*a* rotates in a counterclockwise direction, the transfer sheet S is conveyed to a downstream side of the switchback path 33, which is in a direction toward the sheet stacking tray 41.

When the trailing edge of the transfer sheet S passes the free end of the separation claw 31, the sheet discharging roller 25*a* stops and rotates in a clockwise direction to convey the transfer sheet S to the sheet reverse path 30, as indicated by arrow A shown in FIG. 3.

As shown in FIG. 2, transfer rollers 32*a* and 32*b* that can rotate in both directions are disposed in contact with each other in the sheet reverse path 30. When the transfer sheet S is conveyed in the sheet reverse path 30, the transfer rollers 32*a* and 32*b* hold the transfer sheet S therebetween so as to guide the transfer sheet S to be fed via the reverse sheet conveyance path 24 to the pair of registration rollers 13.

As previously described, the transfer rollers 32*a* and 32*b* are in contact with each other. Therefore, when the transfer roller 32*a* rotates in a counterclockwise direction in FIG. 2, the transfer roller 32*b* is rotated with the transfer roller 32*a* to guide and feed the transfer sheet S that is conveyed through the sheet reverse path 30 toward the pair of registration rollers 13.

Next, a description is given of detailed image forming operations of the duplex printing with the above-described configuration.

After a first image is transferred from the intermediate transfer belt 4 onto a front side or first side of the transfer sheet S, the transfer sheet S is conveyed through a general sheet conveyance path 35 that is indicated by arrow B as shown in FIG. 3. After the fixing operation is conducted in the fixing unit 14, the transfer sheet S is guided by the separation claw 31 that is rotated in a clockwise direction as indicated by the solid line shown in FIG. 3 to the switchback path 33. As the sheet discharging roller 25*a*, which serves as a drive roller, rotates in a counterclockwise direction, the transfer sheet S is conveyed toward the sheet stacking tray 41. Then, after the trail edge of the transfer sheet S has passed the free end of the separation claw 31, the sheet discharging roller 25*a* rotates in a counterclockwise direction. With the change of the direction of rotation of the sheet discharging roller 25*a*, the trailing edge of the transfer sheet S becomes the leading edge thereof so that the transfer sheet S is conveyed toward the transfer rollers 32*a* and 32*b* in the sheet reverse path 30 in the direction as indicated by arrow A in FIG. 3. When the transfer sheet S reaches the pair of registration rollers 13, the pair of registration rollers 13 stops while holding the transfer sheet S therebetween. The pair of registration rollers 13 starts rotating again in synchronization with movement of the intermediate transfer belt 4 to convey the transfer sheet S to the secondary transfer nip portion to form a toner image formed on the intermediate transfer belt 4 onto a back side or second side of the transfer sheet S.

The image to be formed on the second side of the transfer sheet S is formed with the above-described image forming processes as the transfer sheet S travels. That is, the image for the second side of the transfer sheet S is formed with the similar processes to those for forming the full-color toner image on the first side thereof, and the full-color toner image is conveyed by the intermediate transfer belt 4. Except, this time the leading edge of the transfer sheet S is reversed to act as the trailing edge thereof in the sheet reverse path 30. Therefore, the image forming apparatus 100 causes the LSU 8 to emit the laser light beams according to image data output from the opposite side in the direction of conveyance of the transfer sheet S such that the image for the second side of the transfer sheet S can be formed correctly in the same direction of the image on the first side thereof.

Thus, the transfer sheet S having toner images on both sides passes through the general sheet conveyance path 35 indicated by arrow B shown in FIG. 3 for fixing the new image to the second side of the transfer sheet S in the fixing unit 14, and is discharged by the pair of sheet discharging rollers 25*a* and 25*b* to the sheet stacking tray 41. To form images on both sides of the transfer sheet S more efficiently, a control unit, not shown, of the image forming apparatus 100 controls times of forming images on the first and second sides of the transfer sheet S.

In FIGS. 1 and 2, the image forming apparatus 100 further includes a control panel 16. The control panel 16 controls operations performed by the image forming part 2. The control panel 16 is placed on a front side of the main body 1 of the image forming apparatus 100. That is, the sheet discharging part 25 of the image forming apparatus 100 is disposed near the front side of the main body 1, and a sheet (e.g., the transfer sheet S) is discharged to the sheet stacking part 40 from the near side to the far side of the image forming apparatus 100.

The image forming apparatus 100 further includes an upper cover 18. The upper cover 18 is a cover member to cover the image forming part 2 and is disposed on top of the main body 1. A top surface of the upper cover 18 includes or is used as the sheet stacking tray 41 that serves as a sheet stacking table of the sheet stacking part 40. The upper cover 18 has no bank or sheet stopping member at the far end. With this configuration, even if a sheet with its length longer than the sheet stacking tray 41 of the upper cover 18 is conveyed, the leading part of the sheet may not be stopped by the bank and can go over it. Therefore, the long sheet can be stacked thereon without any problem.

As shown in FIG. 2, the upper cover 18 supports the LSU 8 that is disposed below there and included in the image forming part 2. The upper cover 18 rotates upward about a hinge 17 disposed at the far side of the image forming apparatus 100.

A locking lever 60 is disposed to serve as a locking member and locks the upper cover 18 to the main body 1 of the image forming apparatus 100. When the locking lever 60 unlocks the upper cover 18, the upper cover 18 can rotate about the hinge 17.

When the upper cover 18 is rotated in a counterclockwise direction to open, the LSU 8 is rotatably moved upward with the upper cover 18. This action enables a service representative to access units and components of the image forming part 2, thereby easily performing maintenance.

Further, while the upper cover 18 is open, four process cartridges can be detached from or attached to the image forming apparatus 100. Each of the process cartridges integrally includes the photoconductor 3 and image forming units and components (e.g., the charging unit 7, the developing unit 9, and the cleaning unit 11) disposed around the photoconductor 3.

When the upper cover 18 rotates to open, the near side of the sheet stacking tray 41 moves upward and the far side thereof can be positioned lower than the near side thereof. However, if the upper cover 18 rotates upward by mistake when the transfer sheets S are stacked on the sheet stacking tray 41, the transfer sheets S stacked on the sheet stacking tray 41 can fall or slide downward to the far side of the image forming apparatus 100. That is, if a user leaves the stack of the transfer sheet S on the sheet stacking tray 41 and opens the upper cover 18, the transfer sheets S on the sheet stacking tray 41 can fall to the back side of the main body 1 of the image forming apparatus 100. This problem can be solved by providing a bank or sheet stopping member at the far side of the upper cover 18. However, a long sheet can abut against such a bank or sheet stopping member when discharging the long sheet, which can cause a problem to the condition of the sheet stack.

To eliminate the above-described problem, the image forming apparatus 100 according to an example embodiment of the present patent application includes a handle 61 that is positioned on the sheet stacking tray 41 and arranged to be hidden or covered by the stacked transfer sheet S. The handle 61 is used to unlock the locking lever 60 and cause the upper cover 18 to rotate to open.

The locking lever 60 integrally includes the handle 61 at one end thereof for user to operate it and a lock claw 62 at the other end thereof. The lock claw 62 engages with a projection part 64 that is fixedly mounted on the main body 1 of the image forming apparatus 100. The locking lever 60 is rotatable about a pin 63 that is fixedly mounted to the upper cover 18. A screw coil spring, not shown, is attached around the pin 63, and applies, to the lock lever 60, a force exerted in a direction to which the lock claw 62 is constantly engaged with the projection part 64. The handle 61 is formed by a flat material and the surface thereof extends along the surface of the sheet stacking tray 41. The sheet stacking tray 41 includes a concave part 44 that spreads out in a fan-like form, as shown in FIG. 1, in order for a user to hold the handle 61 easily.

As described above, to open the upper cover 18, a user slidingly puts his/her hand to the concave part 44 to hold the handle 61 and lifts the handle 61 of the locking lever 60 upward against the force exerted by the screw coil spring. With this operation, the locking lever 60 rotates about the pin 63 and the lock claw 62 is disengaged with the projection part 64. As the user continuously lifts the handle 61, the upper cover 18 is rotated about the hinge 17.

As described above, the handle 61 of the locking lever 60 is located on the sheet stacking tray 41, thereby surely preventing undesirable rotation and opening of the upper cover 18 while the transfer sheet S is placed on the sheet stacking tray 41.

Figure 4:
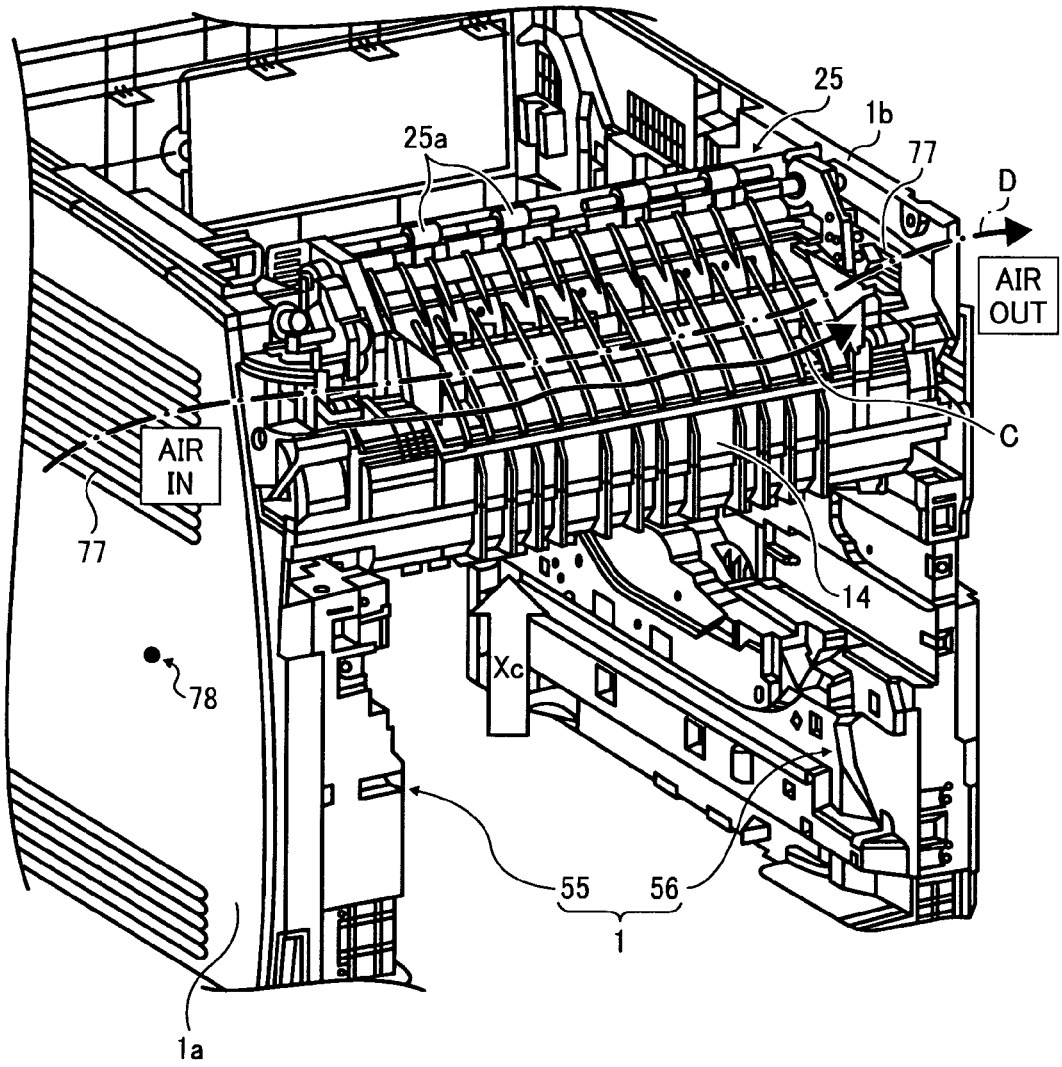
FIG. 4 is a perspective view of the image forming apparatus of FIG. 1 for explaining details of example embodiments.
Figure 5:
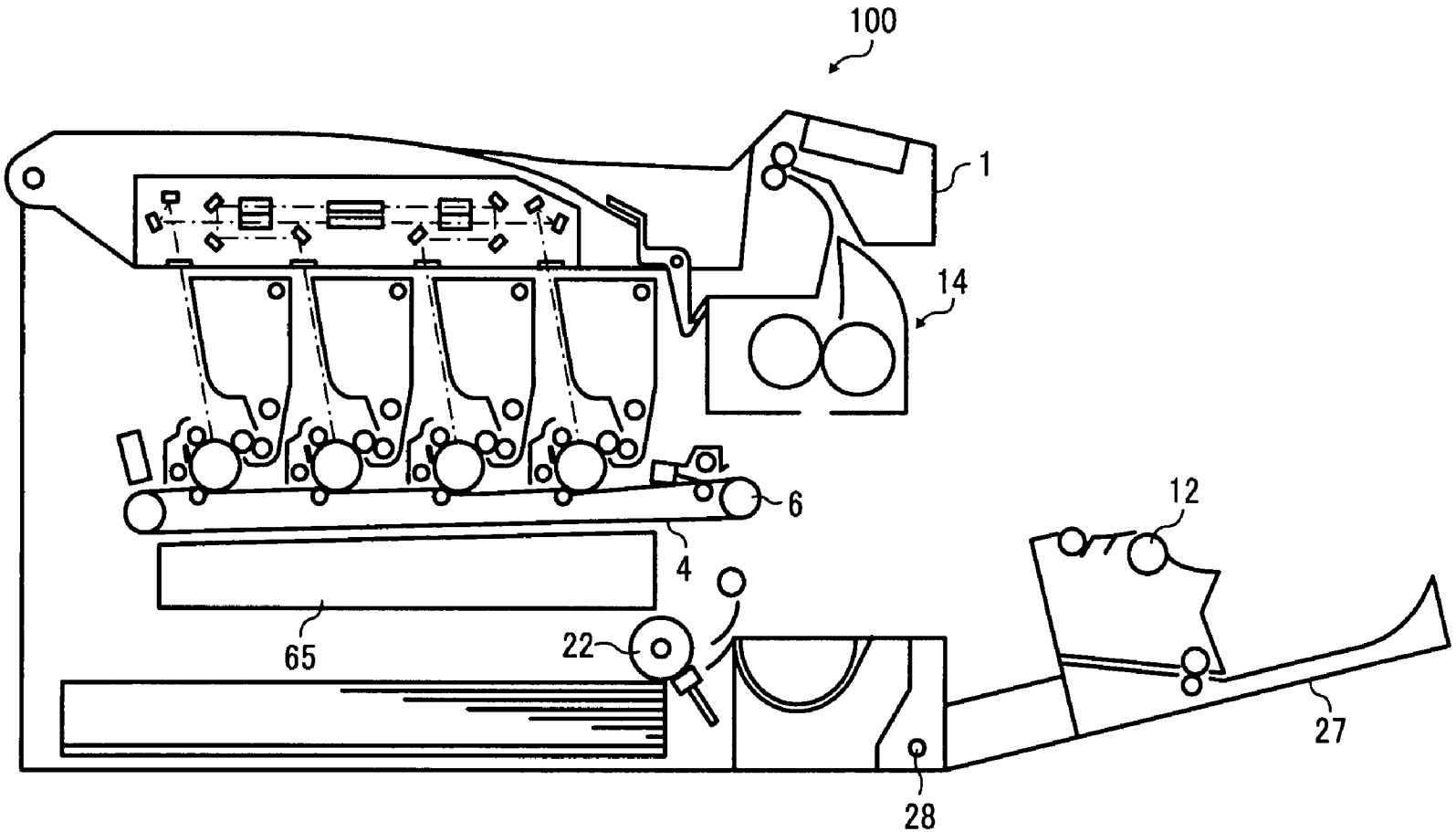
FIG. 5 is a front view of the image forming apparatus of FIG. 1, showing an example of a front cover that is openable and closeable with respect to a main body of the image forming apparatus of FIG. 1.
Figure 6:
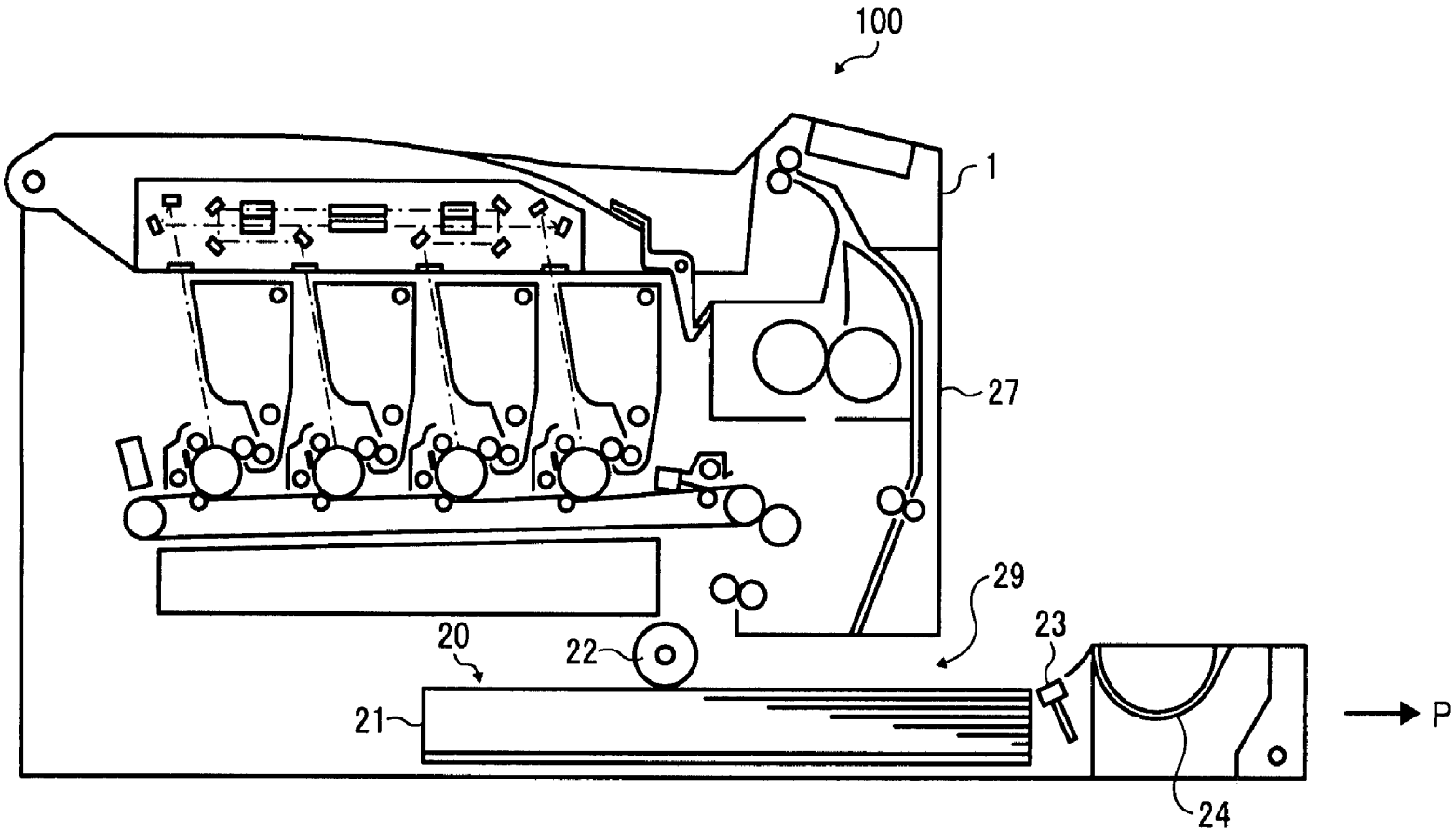
FIG. 6 is a front view of the image forming apparatus of FIG. 1, showing an example that the front cover is detachable from the main body.

Referring to FIGS. 4 through 6, descriptions are given of the detailed configuration of the image forming apparatus 100.

FIG. 4 is a perspective view of the image forming apparatus 100 for explaining details of the configuration. FIG. 5 is a front view of the image forming apparatus 100, showing an example of a front cover 27 that is openable and closeable with respect to the main body 1 of the image forming apparatus 100. FIG. 6 is a front view of the image forming apparatus 100, showing an example that the front cover 27 is detachable from the main body 1.

As shown in FIG. 5, the front cover 27 of the main body 1 rotates about a hinge 28 to open toward a user (to the right-hand side in FIG. 5) so as to show the inside of the main body of the image forming apparatus 100. That is, by opening the front cover 27, replacement and/or maintenance for the intermediate transfer belt 4 and related units or components, a waste toner bottle 65, and the fixing unit 14 and removal of paper(s) jammed in the sheet conveyance path of the main body 1 (see FIG. 4).

Further, as shown in FIG. 6, the main body 1 includes an opening 29 in the front cover 27 to insert the sheet feed tray 21 thereto. With this configuration, the sheet feed tray 21 can be attached to and detached from the main body 1 through the opening 29 from the front side of the image forming apparatus 100, which is in a horizontal direction, left to right and right to left in FIG. 6. FIG. 6 shows that the sheet feed tray 21, the friction pad 23, and the sheet reverse path 24 are pulled together and detached at once from the main body 1 to a direction indicated by arrow P in FIG. 6. By so doing, user and/or service representative can conduct manned operations such as machine maintenance, replacement of consumables, and removable of jammed paper(s) fully from the front side of the main body 1 of the image forming apparatus 100. Accordingly, additional space may not be needed at the back side of the image forming apparatus 100 to perform the above-described manned operations and an installation area can be reduced in size, thereby providing an easily operable, user friendly, and low-cost image forming apparatus.

Next, detailed descriptions are given of the fixing unit 14, the sheet conveyance paths 30 and 35, and units and components disposed therearound, in reference to FIGS. 3 and 4.

In FIG. 3, the image forming apparatus 100 shown in FIG. 3 further includes an upper fixing guide plate 70, an outlet fixing guide plate 71, and a lower fixing guide plate 75.

The upper fixing guide plate 70 serves as a guide member to form the sheet reverse conveyance path 30.

The outlet fixing guide plate 71 is disposed in the vicinity of an exit of the fixing unit 14 and serves as a guide member to form the general sheet conveyance path 35.

The lower fixing guide plate 75 is disposed below the sheet discharging roller 25*b* and serves as a guide member to form the general sheet conveyance path 35.

The "guide member" explained herein has a generic meaning to indicate an original guide member for guiding a paper to a direction it should be conveyed, a member that is connected to the original guide member, and a guide rib that is integrally mounted to the original guide member, etc.

As shown in FIG. 4, the image forming apparatus 100 further includes an external left cover 1*a*, an external right cover 1*b*, a left frame 55, a right frame 56, and a louver 77.

The louver 77 includes multiple openings and/or slots formed on each of the external left cover 1*a* and the external right cover 1*b*.

Further, electrical components are positioned between the left external cover 1*a* that corresponds to a side cover of the main body 1 and the left frame 55, when viewed from the front side of the main body 1.

Further, a direction Xc indicates a direction of conveyance of the transfer sheet S, which corresponds to a vertical direction.

In FIGS. 3 and 4, the front cover 27 (see FIGS. 1 through 4) integrally mounting a guide plate, not shown, that forms the sheet reverse conveyance path 30 is disposed to face the upper fixing guide plate 70.

Further, in FIG. 3, the upper fixing guide plate 70 and the outlet fixing guide plate 71 forms a guide plate unit that is freely openable and closeable about a fulcrum, not shown, disposed an upper left end portion thereof in FIG. 3. By opening the guide plate unit, a user and/or service representative can enhance the operability during maintenance for the fixing unit 14 and jammed paper removal. This effect can be applied to the configurations shown in FIGS. 7 and 8, which will be described below.

Example Embodiment 1

Figure 7B:
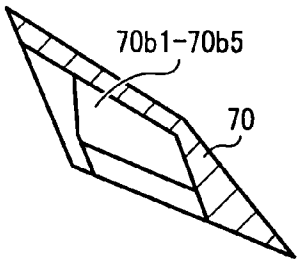
FIG. 7B is a cross-sectional view of an upper fixing guide plate in the image forming apparatus according to Modified Example 3 of the present patent application.
Figure 7A:
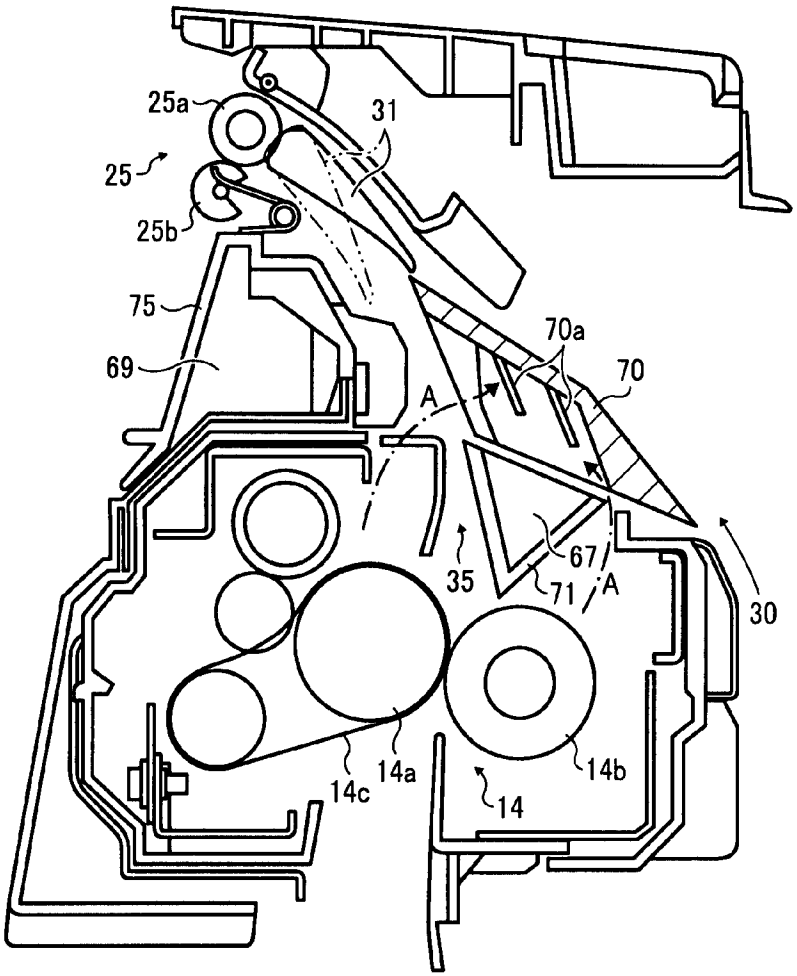
FIG. 7A is a cross-sectional view of the image forming apparatus according to Example 1 and Modified Example 2 of the present patent application.

Referring to FIG. 7A, a description is given of the image forming apparatus 100 according to Example Embodiment 1 of the present patent application.

In FIG. 7A illustrating the configuration according to Example Embodiment 1, the image forming apparatus 100 includes hollow portions 67 and 69.

The hollow portion 67 is located above the fixing unit 14, between the fixing unit 14 and the sheet reverse path 30. The hollow portion 67 is surrounded by the upper fixing guide plate 70 and the outlet fixing guide plate 71. Both of the upper fixing guide plate 70 and the outlet fixing guide plate 71 serve as multiple guide members.

The hollow portion 69 is surrounded by the lower fixing guide plate 75. The lower fixing guide plate 75 is also included in the multiple guide members.

An air current that may include vapor is generated in a heated area of the fixing unit 14 during image forming and flows to the hollow portions 67 and 69 or to inner walls of the upper fixing guide plate 70 and the outlet fixing guide plate 71. The multiple guide members including the upper fixing guide plate 70 and the outlet fixing guide plate 71 form a wind tunnel in the image forming apparatus 100.

In FIG. 7A, the air current with vapor indicated by arrow A travels upward from the fixing unit 14 and is collected to the hollow portion 67 formed and defined by the upper fixing guide plate 70 and the outlet fixing guide plate 71. The upper part of the hollow portion 67 is formed in a wall shape to control the vapor rising from the air current A for effectively collecting the uprising vapor and is formed by two types of guide plates as described above, so that the hollow portion 67 can be sealed more tightly.

Further, the hollow portion 69 can have the similar configuration to the hollow portion 67, except that the hollow portion 69 is formed and defined by the lower fixing guide plate 75, as shown in FIG. 7A.

Example Embodiment 2

Figure 8:
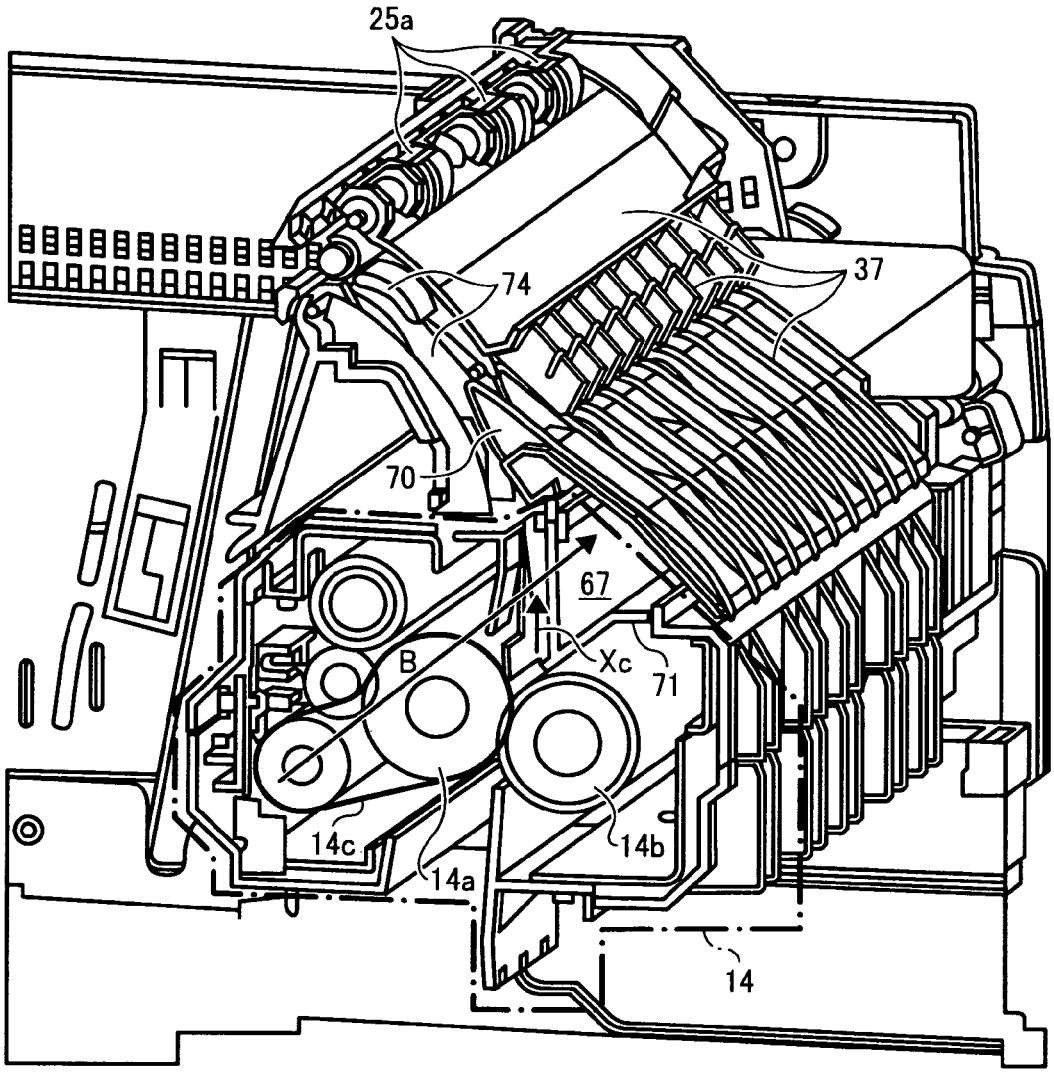
FIG. 8 is a perspective view of the image forming apparatus according to Example Embodiment 2 of the present patent application, viewed from an upper right position.

Referring to FIG. 8, a description is given of the image forming apparatus 100 according to Example Embodiment 2 of the present patent application.

As shown in FIG. 8, the hollow portion 67 extends to enable an air current indicated by arrow B to flows in the hollow portion 67 in a direction substantially perpendicular to the direction Xc that is a direction of conveyance of the transfer sheet S. That is, the air current B travels in the hollow portion 67.

As previously shown in FIG. 4, the louver 77 is formed on each of the left external cover 1*a* of the left frame 55 and the right external cover 1*b* of the right frame 56. Since the temperature in the vicinity of the right side and the temperature in the vicinity of the left side in the main body 1 of the image forming apparatus 100 can be different due to design for air current control in the main body 1. For example, the temperature in the left side of the main body 1 of the image forming apparatus 100 is set to be higher than the temperature in the right side. By so doing, an air current is generated due to a temperature difference in the hollow portion 67.

The air current B that flows in the substantially perpendicular to the direction Xc can be generated either when passing the air taken from the louver 77 through the hollow portion 67 or when forcedly generating the air current B flowing substantially parallel to the longitudinal axis of the fixing unit 14 or in a direction perpendicular to the direction Xc by using, for example, an axial flow fan provided to the image forming apparatus 100.

According to the air current B that flows in a direction perpendicular to the direction Xc, the air current A, which flows from the fixing unit 14 to the hollow portion 67 and is collected to the upper portion of the hollow portion 67, can be further attracted to the hollow portion 67, be increased in the speed of flow of the air current A, and can increase an effect of attraction of vapor to the hollow portion 67.

As described above, the image forming apparatus 100 includes the configuration in which the air current can be generated by receiving air passing through the louver 77 of the left external cover 1*a* or by intaking outside air using the axial flow fan and by exiting the air through the louver 77 of the right external cover 1*b*. With this configuration, fresh external air are taken in so that the fresh external air can cool down the hollow portion 67 to condense the vapor collected in the hollow portion 67 into water droplets or liquid droplets.

The outlet fixing guide plate 71 has two outer faces, which are a first outer face and a second outer face. The first outer face of the outlet fixing guide plate 71 forms the general sheet conveyance path 35 along which the transfer sheet S is conveyed. The first outer face thereof is not affected by fresh air and is heated by the fixing unit 14 of the main body 1 of the image forming apparatus 100. Therefore, the first outer face of the outlet fixing guide plate 71 has a high temperature and water droplets are not adhered to the transfer sheet S and the outlet fixing guide plate 71. The second outer face of the outlet fixing guide plate 71 defines or sections the hollow portion 67, however does not form the general sheet conveyance path 35.

By contrast, inner faces of the upper fixing guide plate 70 and the outlet fixing guide plate 71 along which the air current cooled by fresh air travels or facing the hollow portion 67 have a low temperature so that the cooled air can condenses into water droplets to adhere to the upper fixing guide plate 70 and the outlet fixing guide plate 71. According to these effects, the above-described configuration can be achieved.

Here, the inner faces of the upper fixing guide plate 70 and the outlet fixing guide plate 71 correspond to faces opposite the outer faces of the upper fixing guide plate 70 and the outlet fixing guide plate 71 which form the general sheet conveyance path 35. Specifically, the outlet fixing guide plate 71 has two inner faces, which are a first inner face and a second inner face. The first inner face of the outlet fixing guide plate 71 is formed on an opposite side of the first outer face thereof and defines or sections the hollow portion 67 while the second inner face is formed on an opposite side of the second outer face thereof and defines or sections the hollow portion 67.

Further, by increasing a height of each rib of the upper fixing guide plate 70 and the outlet fixing guide plate 71, the difference between temperatures of the upper fixing guide plate 70 and the outlet fixing guide plate 71 can be larger.

In FIG. 8, the image forming apparatus 100 further includes a duplex guide member 37 and a sheet discharging guide member 74.

The duplex guide member 37 is provided as a transfer guide of the sheet reverse path 30.

The sheet discharging guide member 74 is provided as a transfer guide of the sheet discharging path 26.

As shown in FIG. 4, the image forming apparatus 100 further includes electrical components that are mounted together on a component assembly portion 78 located between the left frame 78 and the left external cover 1*a* so as to enhance the positional efficiency of electric components such as harness wiring. In the image forming apparatus 100 shown in FIG. 4, air currents C and D that include vapor also flow in the hollow portion 67 in a direction perpendicular to the direction Xc of conveyance of the transfer sheet S. The air currents C and D are controlled to flow in a direction opposite the component assembly portion 78, thereby preventing failure due to adhesion of water droplets to the electrical components.

Modified Example 1

In addition to Example Embodiments 1 and 2, a different example, Modified Example 1, can be applied to the present patent application.

In Modified Example 1, a moisture absorbing material may be provided on the inner faces of the upper fixing guide plate 70 and the outlet fixing guide plate 71 that define the hollow portion 67 or in the hollow portion 67. The moisture absorbing member absorbs and easily stores water droplets from condensation of vapor generated in the fixing unit 14 within the hollow portion 67.

Modified Example 2

In addition to Example Embodiments 1 and 2 and Modified Example 1, yet another example, Modified Example 2, can be applied to the present patent application, in reference to FIG. 7A, which is also used in Example Embodiment 1, and FIGS. 9A through 9D.

Figure 9A:
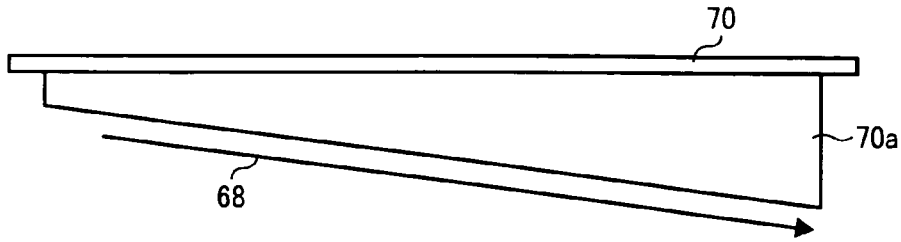
FIG. 9A is a cross-sectional view of the upper fixing guide plate of a fixing unit according to Modified Example 2 of the present patent application.
Figure 9B:
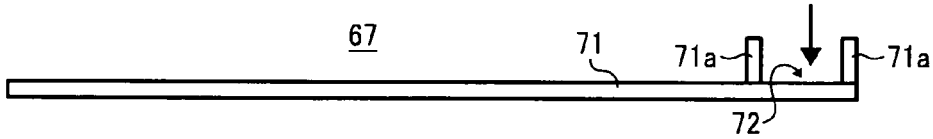
FIG. 9B is a cross-sectional view of an outlet fixing guide plate of the fixing unit according to Modified Example 2 of the present patent application.
Figure 9C:
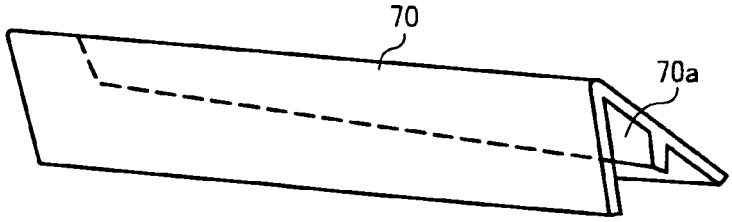
FIG. 9C is a perspective view of the upper fixing guide plate of the fixing unit according to Modified Example 2 of the present patent application.
Figure 9D:
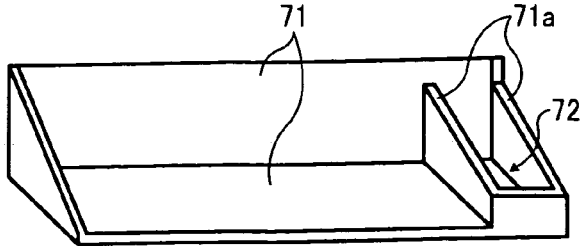
FIG. 9D is a perspective view of a collecting portion of the fixing unit according to Modified Example 2 of the present patent application.

FIG. 9A is a cross-sectional view of the upper fixing guide plate 70 of the fixing unit 14, FIG. 9B is a cross-sectional view of the outlet fixing guide plate 71 of the fixing unit 14, FIG. 9C is a perspective view of the upper fixing guide plate 70 of the fixing unit 14, and FIG. 9D is a perspective view of a liquid collector 72 of the fixing unit 14.

As shown in FIGS. 7A and 9A through 9D according to Modified Example 2, the image forming apparatus 100 further includes a guide rib 70*a* that serves as a liquid guide member. The guide rib 70*a* is flared or increases in thickness as it extends toward the liquid collector 72 and is disposed on the inner surface of the upper fixing guide plate 70 the defines the hollow portion 67. With this configuration, water droplets 68 included in liquid droplets can be guided and conveyed to a target portion.

In Modified Example 2, the guide rib 70*a* guides the water droplets 68, which are adhered to the inner face of the upper fixing guide plate 70, to the liquid collector 72 so that the water droplets 68 can be stored and reserved therein. The liquid collector 72 serves as a collecting portion and is surrounded and defined by a guide rib 71*a* that is mounted on the first inner face of the outlet fixing guide plate 71 disposed below the upper fixing guide plate 70.

Modified Example 3

In addition to Example Embodiments 1 and 2 and Modified Example 1, yet another example, Modified Example 3, can be applied to the present patent application, in reference to FIG. 7B and FIGS. 10A through 10E.

Figure 10A:
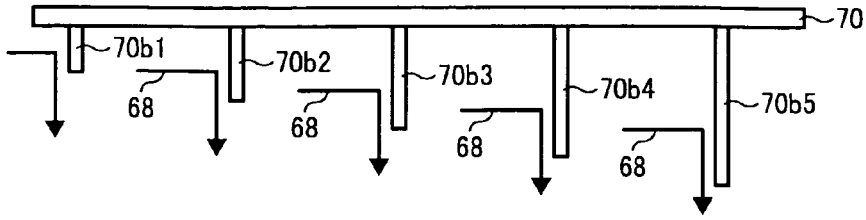
FIG. 10A is a cross-sectional view of an upper fixing guide plate of a fixing unit according to Modified Example 3 of the present patent application.
Figure 10B:
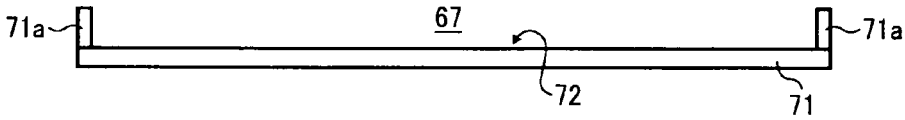
FIG. 10B is a cross-sectional view of an outlet fixing guide plate of the fixing unit according to Modified Example 3 of the present patent application.
Figure 10C:
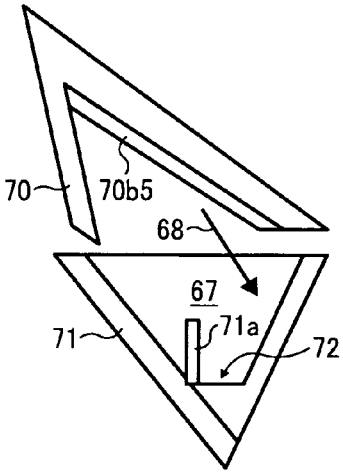
FIG. 10C is a cross sectional view of the upper fixing guide plate, the outlet fixing guide plate, and the collecting portion of the fixing unit according to Modified Example 3 of the present patent application.
Figure 10D:
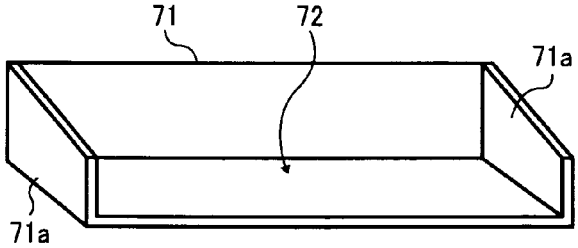
FIG. 10D is a perspective view of the outlet fixing guide plate of the fixing unit according to Modified Example 3 of the present patent application.
Figure 10E:
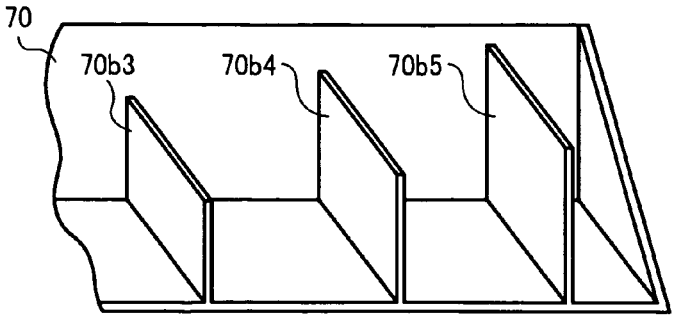
FIG. 10E is an enlarged perspective view of the upper fixing guide plate of the fixing unit according to Modified Example 3 of the present patent application.

FIG. 7B illustrates the upper fixing guide plate 70 including ribs 70*b*1 through 70*b*5, FIG. 10A illustrates the upper fixing guide plate 70, viewed from an angle different from FIG. 7B, FIG. 10B illustrates the outlet fixing guide plate 71 including the guide ribs 71*a*, FIG. 10C illustrates the upper fixing guide plate 70 and the outlet fixing guide plate 71, viewed from the external left cover 1*a* of the image forming apparatus 100, FIG. 10D illustrates the liquid collector 72 formed on the outlet fixing guide plate 71, and FIG. 10E is an enlarged perspective view of the upper fixing guide plate 70.

As shown in FIGS. 7B, 10A, 10C, and 10D, the upper fixing guide plate 70 includes the ribs 70*b*1 through 70*b*5 that serve as liquid guide members. The ribs 70*b*1 through 70*b*5 are arranged along the direction Xc on the first inner face of the upper fixing guide plate 70 with different steps in height. That is, as shown in FIG. 10A, the ribs 70*b*1 through 70*b*5 are formed gradually higher or longer than its left adjacent rib so that the heights of the ribs 70*b*1 through 70*b*5 can be greater along a direction to which the air current flows. Therefore, the rib 70*b*1 becomes shortest and the rib 70*b*5 becomes longest as a result.

Further, as shown in FIGS. 10B, 10C, and 10D, the liquid collector 72 is formed and defined by the guide ribs 71*a* disposed on the inner face of the outlet fixing guide plate 71.

With the above-described configuration, the water droplets 68 adhering to the ribs 70*b*1 to 70*b*5 are guided to fall onto the liquid collector 72. With this action, the water droplets 68 can be conveyed to the outlet fixing guide plate 71 with high temperature due to being disposed in the vicinity of the heated area of the fixing unit 14. Therefore, the water droplets 68 can be evaporated more effectively and more quickly.

Modified Example 4

Figure 11:
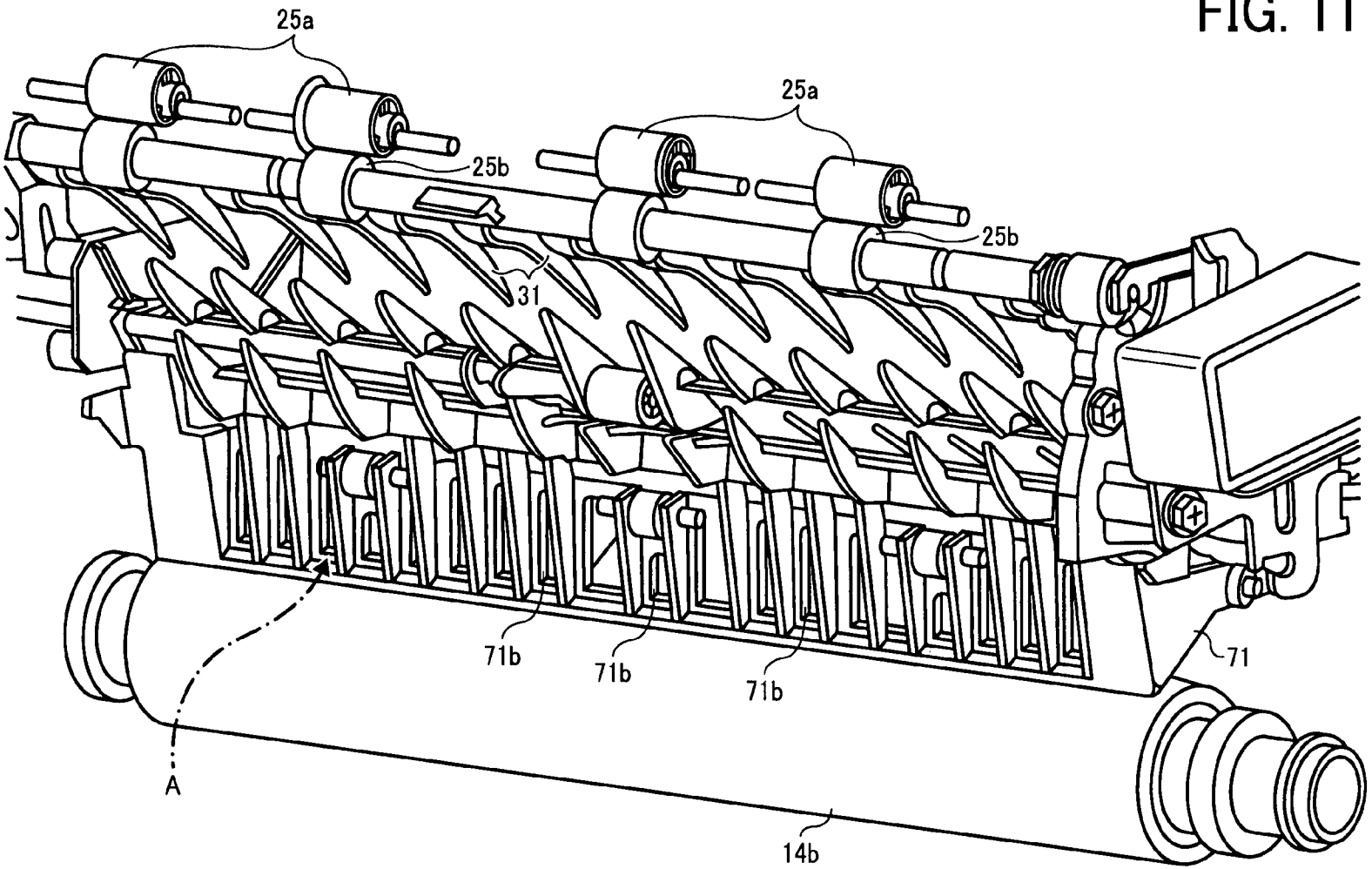
FIG. 11 is a perspective view of an exit guide plate of a fixing unit according to Modified Example 4 of the present patent application.

In addition to Example Embodiments 1 and 2 and Modified Examples 1, 2, and 3, yet another example, Modified Example 4, can be applied to the present patent application, in reference to FIG. 11.

FIG. 11 illustrates the output fixing guide plate 71 and the image forming components mounted on and disposed in the vicinity of the output fixing guide plate 71. That is, the upper fixing guide plate 70 and the outlet fixing guide plate 71 form a wind tunnel between the hollow portion 67 and the fixing unit 14.

As shown in FIG. 11 according to Modified Example 4, the outlet fixing guide plate 71 has multiple openings 71*b* formed thereon. With this configuration, the image forming apparatus 100 can intake the air current A easily from the multiple openings 71*b* to the hollow portion 67 disposed substantially directly above the fixing unit 14. That is, the outlet fixing guide plate 71 can collect and store the water droplets 68, increase the temperature or be heated in the vicinity of the heated area of the fixing unit 14, and cause the air current to flow.

As described above, any of the configurations according to the above-described example embodiments and/or modified examples can perform the above-described operations and actions. Therefore, the present patent application can have the following effects.

By utilizing the hollow portion 67 defined by the multiple guide plates (e.g., the upper fixing guide plate 70, the outlet fixing guide plate 71, and the lower fixing guide plate 75) to enable an air current to pass through the hollow portion during image forming, the water droplets or liquid droplets 68 from condensation of vapor generated in the fixing unit 14 can be collected to the hollow portion 67 without providing an additional unit to eliminate the water droplets 68, thereby effectively preventing defective images.

By extending the hollow portion to enable the air current to follow therein in a direction substantially perpendicular to the direction of conveyance of the transfer sheet S, an amount of air current to collect the vapor generated after fixing, to the hollow portion 67.

By cooling down the inner faces of the upper fixing guide plate 70 and the outlet fixing guide plate 71, the water droplets 68 can adhere to the inner faces thereof defining the hollow portion 67 so as to avoid the water droplets 68 to the transfer sheet S, and a longitudinal or widthwise direction of the multiple guide members extending substantially perpendicular to the direction of conveyance of the transfer sheet S can be cooled so as to eliminate the water droplets 68 in the widthwise direction of the transfer sheet S.

By controlling the air current to flow in the direction opposite the side cover (e.g., the external left cover 1*a*) with the electrical components mounted thereon, the adhesion of water droplets 68 to the electrical components as well as the transfer sheet S can be prevented.

By providing a moisture absorbing material to absorb and store the water droplets 68 from condensation of vapor generated in the fixing unit 14 within the hollow portion 67, the water droplets 68 may not be conveyed to the sheet conveyance paths (e.g., the general sheet conveyance path 35 and the sheet reverse path 30) and/or the electrical components mounted on the external left cover 1*a*.

By providing the collecting portion (e.g., the liquid collector 74) and the liquid guide member (e.g., the guide rib 70*a* and the ribs 70*b*1 through 70*b*5), the water droplets 68 can be collected and stored outside the sheet conveyance paths and within the hollow portion 67, thereby preventing failures such as adhesion of water droplets 68 to the transfer sheet S.

By providing the collecting portion in the fixing unit 14, the water droplets 68 can be conveyed to the heated area of the fixing unit 14, thereby evaporating or eliminating the water droplets 68 more quickly.

By forming a wind tunnel by the multiple guide members to pass through the hollow portion 67 in the fixing unit 14, any additional unit such as an air duct for securing the wind passage, thereby reducing the number of parts, costs, and size in the apparatus.

The present patent application is not limited to an image forming apparatus that employs an in-body paper eject type. For example, the present patent application is also applicable to a monochrome copier, a monochrome laser printer, an inkjet printer, and an image forming apparatus that employs a tandem type with a direct transfer system in which a transfer sheet is conveyed on a transfer member for sequentially overlaying toner images. The present patent application is of course applicable to an image forming apparatus that employs an image carrier of an endless belt type. Specifically, a compact, lightweight image forming apparatus can achieve the above-described effects.

Although the invention has been described with respect to a specific embodiment for a complete and clear disclosure, the appended claims are not to be limited as shown in the above-described example embodiments and modified examples with reference to FIGS. 1 through 11 but are to be construed as embodying all modifications and alternative constructions that may occur to one skilled in the art that fairly fall within the basic teaching herein set forth.

The above-described exemplary embodiments are illustrative, and numerous additional modifications and variations are possible in light of the above teachings. For example, elements and/or features of different illustrative and exemplary embodiments herein may be combined with each other and/or substituted for each other within the scope of this disclosure. It is therefore to be understood that, the disclosure of this patent specification may be practiced otherwise than as specifically described herein.

Obviously, numerous modifications and variations of the present invention are possible in light of the above teachings. It is therefore to be understood that, the invention may be practiced otherwise than as specifically described herein.

What is claimed is:

1. An image forming apparatus, comprising:

a transfer unit to transfer an image onto a transfer sheet;

a fixing unit disposed downstream from the transfer unit in a direction of conveyance of the transfer sheet, the fixing unit fixing the image to the transfer sheet by application of heat and conveying the fixed transfer sheet to a further downstream portion of the image forming apparatus;

a discharging unit disposed downstream from the fixing unit in the direction of conveyance of the transfer sheet, the discharging unit discharging the transfer sheet to an external portion of the image forming apparatus; and multiple guide members disposed above the fixing unit to form a sheet conveyance path, the multiple guide members comprising:

a first guide member; and a second guide member, wherein the first and second guide members define a hollow portion therebetween, the second guide member includes a collecting portion, and the first guide member includes a liquid guide member, the sheet conveyance path including a first path through which the transfer sheet is conveyed toward the discharging unit; and a second path through which the transfer sheet from the first path is conveyed to receive another image on another side thereof, wherein both the first path and the second path of the sheet conveyance path and the hollow portion are configured to enable an air current generated during image forming to pass therethrough, the first guide member is configured to form vapor condensate on an inside surface thereof from the air current in the hollow portion, the collecting portion is configured to collect liquid droplets of the vapor condensate, and the liquid guide member is configured to direct the formed vapor condensate to the collecting portion.

2. The image forming apparatus according to claim 1, wherein the liquid guide member includes a length, a width and a thickness, and wherein the liquid guide member increases in at least one of the width or the thickness along a length thereof.

3. The image forming apparatus according to claim 1, wherein the hollow portion extends to enable the air current to flow therein in a direction substantially perpendicular to the direction of conveyance of the transfer sheet.

4. The image forming apparatus according to claim 3, further comprising a side cover having electrical components mounted thereon, wherein the air current includes vapor generated in a heated area of the fixing unit, and the air current that includes the vapor flows in a direction opposite the side cover having the electrical components mounted thereon.

5. The image forming apparatus according to claim 1, further comprising side covers disposed extending in a direction intersecting a longitudinal axis of the fixing unit at both ends of the fixing unit, wherein each of the side covers comprise multiple louvers that define multiple openings therein, and the air current is generated by passing through the multiple openings of the side covers.

6. The image forming apparatus according to claim 1, further comprising:

side covers disposed extending in a direction intersecting a longitudinal axis of the fixing unit at both ends of the fixing unit, wherein each of the side covers comprise multiple louvers that define multiple openings therein, and the air current is generated by a forcedly generated flow of air substantially parallel to the longitudinal axis of the fixing unit.

7. The image forming apparatus according to claim 1, wherein at least one of the first guide member and the second guide member includes a moisture absorbing material to absorb and store liquid droplets from condensation of vapor generated in the fixing unit within the hollow portion.

8. The image forming apparatus according to claim 1, wherein the liquid guide members comprise a plurality of ribs, wherein each of the ribs is disposed on an inside surface of the first guide member.

9. The image forming apparatus according to claim 1, wherein the collecting portion is defined by a guide rib and is included in the fixing unit.

10. The image forming apparatus according to claim 1, wherein the multiple guide members form a wind tunnel to allow the air current to pass through the hollow portion.

11. An image forming apparatus, comprising:

means for transferring an image onto a transfer sheet;

means for fixing the image to the transfer sheet by application of heat and conveying the fixed transfer sheet to a further downstream portion of the image forming apparatus;

means for discharging the transfer sheet to an external portion of the image forming apparatus; and means for forming a sheet conveyance path, the means for forming a sheet conveyance path comprising:

a first guide member; and a second guide member, wherein the first and second guide members define a hollow portion therebetween, the second guide member includes a means for collecting liquid droplets, and the first guide member includes a means for guiding the liquid droplets, the sheet conveyance path including a first path through which the transfer sheet is conveyed for operations of the means for discharging; and a second path through which the transfer sheet from the first path is conveyed to receive another image on another side thereof;

wherein both the first path and the second path of the sheet conveyance path and the hollow portion defined by the means for forming are configured to enable an air current generated during image forming to pass therethrough, the first guide member is configured to form vapor condensate from the air current in the hollow portion, the means for collecting is configured to collect liquid drops of the vapor condensate, and the means for guiding is configured to direct the formed vapor condensate to the means for collecting.

12. The image forming apparatus according to claim 11, wherein the air current includes vapor generated by heat from the means for fixing.

13. The image forming apparatus according to claim 12, wherein the hollow portion extends to enable the air current to flow therein in a direction substantially perpendicular to the direction of conveyance of the transfer sheet.

14. The image forming apparatus according to claim 13, further comprising a side cover having electrical components mounted thereon, wherein the air current that includes the vapor flows in a direction opposite the side cover having the electrical components mounted thereon.

15. The image forming apparatus according to claim 11, further comprising means for sending the air current into the image forming apparatus.

16. The image forming apparatus according to claim 15, wherein the air current cools down the hollow portion.

17. The image forming apparatus according to claim 11, wherein the means for forming the sheet conveyance path includes means for absorbing liquid droplets from condensation of vapor generated in the means for fixing.

18. The image forming apparatus according to claim 11, wherein the means for forming forms a wind tunnel to allow the air current to pass through the hollow portion.

19. The image forming apparatus according to claim 11, wherein the means for collecting is included in the means of fixing.

* * * * *